US009466440B2

(12) United States Patent
Sonobe

(10) Patent No.: US 9,466,440 B2
(45) Date of Patent: Oct. 11, 2016

(54) SWITCH DEVICE WITH ERRONEOUS OPERATION PREVENTER AND THE ERRONEOUS OPERATION PREVENTER

(71) Applicant: Yamaha Corporation, Hamamatsu-shi, Shizuoka-ken (JP)

(72) Inventor: Atsushi Sonobe, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 14/636,327

(22) Filed: Mar. 3, 2015

(65) Prior Publication Data

US 2015/0255229 A1 Sep. 10, 2015

(30) Foreign Application Priority Data

Mar. 6, 2014 (JP) ..... 2014-044166

(51) Int. Cl.

| | |
|---|---|
| ***H01H 9/02*** | (2006.01) |
| ***H01H 23/04*** | (2006.01) |
| *H01H 9/28* | (2006.01) |
| *H01H 23/24* | (2006.01) |

(52) U.S. Cl.

CPC ..... *H01H 9/0264* (2013.01); *H01H 23/04* (2013.01); *H01H 9/287* (2013.01); *H01H 23/24* (2013.01); *H01H 2239/03* (2013.01); *H01H 2300/024* (2013.01)

(58) Field of Classification Search

CPC ..... H01H 9/0264; H01H 9/287; H01H 2300/024; H01H 23/24; H01H 2239/03; H01H 23/04

USPC ..... 200/333–334, 43.11, 43.13, 43.14, 200/43.16–43.19, 304

See application file for complete search history.

(56) References Cited

U.S. PATENT DOCUMENTS 2,141,936 A 12/1938 Schmitt
2,169,860 A * 8/1939 Von Hoorn ..... H01H 9/282 200/322

(Continued)

FOREIGN PATENT DOCUMENTS

GB 1060579 3/1967
GB 1134420 11/1968

(Continued)

OTHER PUBLICATIONS

European Search Report issued in counterpart European Application No. 15156442.4 dated Jul. 9, 2015 (seven (7) pages).

*Primary Examiner* — Edwin A. Leon

(74) *Attorney, Agent, or Firm* — Crowell & Moring LLP

(57) ABSTRACT

A switch device with an erroneous operation preventer, including: a switch main body having a switch member supported by a shaft with respect to a casing and configured such that pushing a first end portion of the switch member causes a second end portion thereof to protrude and such that an on state and an off state of the switch main body are changed by pushing one of the first and second end portions; and a frame-shaped erroneous operation preventer disposed around the switch member for preventing an erroneous operation on the first end portion that takes a protruding posture when the switch main body is in one of the on and off states, the preventer having side protective walls extending in a longitudinal direction of the switch member so as to cover a surface of a flange portion of the casing on both sides of the first end portion.

14 Claims, 13 Drawing Sheets

(56) References Cited

U.S. PATENT DOCUMENTS 4,609,119 A * 9/1986 Richter, Sr. ..... H01R 13/745 200/295
5,290,979 A * 3/1994 Grass ..... H01H 9/286 200/43.19
5,907,140 A 5/1999 Smith
6,137,068 A * 10/2000 Padulo ..... H01H 9/287 200/333

FOREIGN PATENT DOCUMENTS

JP 62-144029 U 9/1987
JP 4487790 B2 6/2010

* cited by examiner

SWITCH DEVICE WITH ERRONEOUS OPERATION PREVENTER AND THE ERRONEOUS OPERATION PREVENTER

CROSS REFERENCE TO RELATED APPLICATION

The present application claims priority from Japanese Patent Application No. 2014-044166, which was filed on Mar. 6, 2014, the disclosure of which is herein incorporated by reference in its entirety.

BACKGROUND OF THE INVENTION

1. Field of the Invention

The present invention relates to a seesaw-shaped switch device provided on a wall of a housing or the like of electric and electronic equipment and configured such that an on state and an off state are changed by a pivotal movement of a switch member. More particularly, the invention relates to such a switch device with an erroneous operation preventer for preventing the switch device from being erroneously disconnected or connected. The invention further relates to such an erroneous operation preventer.

2. Description of Related Art

A seesaw-shaped switch device that may be referred to as a rocker switch or a wave-shaped switch is provided so as to be partly embedded in a wall of a housing or the like of electric and electronic equipment. Such a switch device is configured such that pushing one end portion of a switch member, which is pivotally supported by a shaft parallel to the walls surface, causes another end portion to protrude from the wall and such that an on state and an off state are changed by pushing one of the one end portion and another end portion.

Some of the switch devices constructed as described above have an erroneous operation preventer for preventing an end portion of the switch member from being erroneously pushed, the end portion taking a protruding posture with respect to the wall when the switch device is in one of the on state and the off state.

Patent Literature 1 discloses a switch device with an erroneous operation preventer (protector) screwed to a chassis of a switch main body. The erroneous operation preventer has a frame portion and protective walls that are formed integrally by bending a metal plate. The frame portion is disposed around a periphery of the switch member, and the protective walls extend upright from respective side edges of the frame portion. The protective walls have a size larger than that of side surfaces of the switch member and extend upright on both sides of the switch member. Consequently, the upper end of each protective wall is located at a height position higher than a height position of an apex portion of the switch member. This prevents a finger from erroneously touching the switch member, so that an erroneous operation on the switch member is prevented.

Like Patent Literature 1, Patent Literature 2 discloses a switch device with an erroneous operation preventive mechanism that has protective walls extending upright on both sides of a switch member and an operation locking bar pivotally attached to and extending across the protective walls. Placing the operation locking bar over the switch member prohibits the switch member from being operated.

Patent Literature 1: JP-UM-A-62-144029

Patent Literature 2: Japanese Patent No. 4487790

SUMMARY OF THE INVENTION

The switch device described in Patent Literature 1 in which a distance between the protective walls is larger than a width of the switch member cannot fully prevent an erroneous operation on the switch member by a finger that gets in between the protective walls. The switch device described in Patent Literature 2 in which the operation locking bar is provided inevitably has an increased number of components, resulting in an increased cost for manufacture.

The present invention has been developed to provide a switch device with an erroneous operation preventer that is relatively inexpensive and that ensures a function of preventing an erroneous operation with high reliability and to provide such an erroneous operation preventer.

The present invention provides a switch device with an erroneous operation preventer, comprising: a switch main body (20) attached to an opening portion (11) of a wall (10) and having a switch member (22) pivotally supported by a shaft (24) that is parallel to the wall, the switch main body being configured such that pushing a first end portion (25) of the switch member causes a second end portion (26) thereof to protrude from the wall and such that an on state and an off state of the switch main body are changed by pushing one of the first end portion and the second end portion of the switch member; and an erroneous operation preventer (30) configured to prevent an erroneous operation on the first end portion of the switch member, the first end portion taking a protruding posture in which the first end portion protrudes from the wall when the switch main body is in one of the on state and the off state, wherein the switch member is supported by the shaft in a casing (21) fixed to the opening portion, wherein the casing has a flange portion (21*a*) contacting the wall and disposed around a periphery of the switch member, wherein the erroneous operation preventer is formed in a frame shape and disposed around the periphery of the switch member, and wherein the erroneous operation preventer has a pair of side protective walls (31) that extend in a longitudinal direction of the switch member so as to cover a surface of the flange portion on both sides of the first end portion of the switch member.

The present invention also provides an erroneous operation preventer used for a switch device (20) and formed in a frame shape so as to be disposed around a periphery of a switch member (22) of the switch device, wherein the switch member is pivotally supported by a shaft (24) parallel to a wall (10) with respect to a casing (21) fixed to an opening portion (11) of the wall, the switch device being configured such that pushing a first end portion (25) of the switch member causes a second end portion (26) thereof to protrude from the wall and such that an on state and an off state of the switch device are changed by pushing one of the first end portion and the second end portion of the switch member, wherein the erroneous operation preventer has a pair of side protective walls (31) configured to extend on both sides of the first end portion of the switch member when the erroneous operation preventer is disposed around the periphery of the switch member, the first end portion taking a protruding posture in which the first end portion protrudes from the wall when the switch device is in one of the on state and the off state, and wherein the side protective walls are disposed so as to cover a surface of a flange portion (21*a*) of the casing, the flange portion being disposed around the periphery of the switch member and contacting the wall.

The present invention further provides an erroneous operation preventer used for a switch device (20) and formed in a frame shape so as to be disposed around a periphery of a switch member (22) of the switch device, wherein the switch member is pivotally supported by a shaft (24) parallel to a wall (10) in a casing (21) fixed to an opening portion (11) of the wall, the switch device being configured such that pushing a first end portion (25) of the switch member causes a second end portion (26) thereof to protrude from the wall and such that an on state and an off state of the switch device are changed by pushing one of the first end portion and the second end portion of the switch member, wherein the erroneous operation preventer has: a pair of side protective walls that extend in a longitudinal direction of the switch member on both sides of the first end portion of the switch member, the first end portion taking a protruding posture in which the first end portion protrudes from the wall when the switch device is in one of the on state and the off state; and a pair of side frame portions that extend in the longitudinal direction on both sides of the second end portion of the switch member, the second end portion being opposite to the first end portion in the longitudinal direction, and wherein a distance between the side protective walls in a direction perpendicular to the longitudinal direction is smaller than a distance between the side frame portions in the direction perpendicular to the longitudinal direction.

FORMS OF THE INVENTION

There will be described forms of the invention.

A switch device with an erroneous operation preventer, comprising: a switch main body (20) attached to an opening portion (11) of a wall (10) and having a switch member (22) pivotally supported by a shaft (24) that is parallel to the wall, the switch main body being configured such that pushing a first end portion (25) of the switch member causes a second end portion (26) thereof to protrude from the wall and such that an on state and an off state of the switch main body are changed by pushing one of the first end portion and the second end portion of the switch member; and an erroneous operation preventer (30) configured to prevent an erroneous operation on the first end portion of the switch member, the first end portion taking a protruding posture in which the first end portion protrudes from the wall when the switch main body is in one of the on state and the off state, wherein the switch member is supported by the shaft in a casing (21) fixed to the opening portion, wherein the casing has a flange portion (21*a*) contacting the wall and disposed around a periphery of the switch member, wherein the erroneous operation preventer is formed in a frame shape and disposed around the periphery of the switch member, and wherein the erroneous operation preventer has a pair of side protective walls (31) that extend in a longitudinal direction of the switch member so as to cover a surface of the flange portion on both sides of the first end portion of the switch member.

According to the switch device with an erroneous operation preventer constructed as described above (hereinafter simply referred to as "the switch device" where appropriate), the side protective walls of the erroneous operation preventer are provided so as to cover the flange portion of the casing of the switch main body. The side protective walls can be disposed such that inner surfaces thereof are located closer to the switch main body than an outer peripheral edge of the flange portion is to the switch main body, so that the switch device with the erroneous operation preventer exhibits an erroneous operation preventive function with high reliability. The erroneous operation preventer formed in the frame shape so as to be disposed around the periphery of the switch member is simple in structure and is installed such that the side protective walls cover the flange portion of the casing after the switch main body has been attached to the opening portion of the wall. Thus, the present switch device is easily installed and low in cost.

The erroneous operation preventer need not necessarily surround the entire periphery of the switch member. Where the switch member is rectangular in plan view, it is only required for the erroneous operation preventer to have a shape that surrounds at least three sides of the rectangular switch member including its both sides along the longitudinal direction.

In the switch device constructed as described above, an operation surface (22*a*) of the switch member may be a concave surface that connects the first end portion and the second end portion of the switch member in the longitudinal direction, and wherein a surface (31*a*) of each of the side protective walls may be a concave surface along the operation surface of the first end portion when the first end portion is taking the protruding posture.

According to the switch device constructed as described above, the surface of each side protective wall is a concave surface along the operation surface of the switch member. It is thus possible to prevent a finger from getting in between the side protective walls and to ensure the erroneous operation preventive function with higher reliability.

In the switch device constructed as described above, the erroneous operation preventer may have a pair of side frame portions (32) that extend in the longitudinal direction on both sides of the second end portion (26) of the switch member so as to be located outwardly of the flange portion, the second end portion being opposite to the first end portion in the longitudinal direction, and wherein a surface (32*a*) of each of the side frame portions may be formed along the operation surface of the second end portion when the first end portion is taking the protruding posture.

The side protective walls have a small height and are disposed outwardly of the flange portion near the second end portion of the switch member. Thus, an operation on the second end portion by an operator is not hindered.

In the switch device constructed as described above, a distance between the side protective walls in a direction perpendicular to the longitudinal direction may be smaller than a distance between the side frame portions in the direction perpendicular to the longitudinal direction.

In the switch device constructed as described above, the erroneous operation preventer may have an end protective wall (33) disposed between the side protective walls so as to face a distal end face (22*b*) of the first end portion, and the end protective wall may extend so as to be inclined such that an end portion of the end protective wall is positioned close to an apex portion (22*c*) between the distal end face and the operation surface.

According to the switch device constructed as described above, the end protective wall is configured such that, even when a finger of the operator partly gets in between the side protective walls by a slight amount, the end of the end protective wall comes into contact with the finger and prevents the finger from further getting in between the side protective walls. In this instance, the end protective wall formed so as to be inclined comes into contact with the finger at an early stage, in other words, the end protective wall comes into contact with the finger before the finger deeply gets in between the side protective walls, thus preventing an erroneous operation with high reliability.

In the switch device constructed as described above, the erroneous operation preventer may have a distal frame portion (34) that connects the side frame portions on a more distal side than the second end portion of the switch member, wherein the distal frame portion may have a distal claw (35) configured to engage with a distal recess (15) formed in the wall, wherein each of the side protective walls may have a side claw (36) configured to engage with a corresponding one of side recesses (16) formed in the wall, and wherein an end face of each of the side claws may be formed so as to be inclined with respect to a longitudinal direction of the side frame portions, such that the end face is parallel to the wall when the distal claw engages with the distal recess and the side claws are positioned close to the respective side recesses.

According to the switch device constructed as described above, the erroneous operation preventer is installed on the switch main body after the switch main body has been attached to the opening portion of the wall. In this instance, the distal claw is initially brought into engagement with the distal recess, and the side claws are moved close to the respective the side recesses while pivoting the erroneous operation preventer about the engaged portion, for engagement of the side claws with the respective side recesses. When the side claws are moved close to the respective side recesses, the end face of each side claw is parallel to the wall, preventing the erroneous operation preventer from being installed in an inclined posture. Consequently, the switch device with the erroneous operation preventer exhibits its erroneous operation preventing function with high reliability.

In the switch device constructed as described above, the erroneous operation preventer may have at least one guide projection (37) configured to be insertable into at least one guide recess (17) formed in the wall, the at least one guide projection protruding by a larger amount than the side claws.

When the erroneous operation preventer is attached to the wall, the erroneous operation preventer is pivoted with the distal claw held in engagement with the distal recess, and the side claws are subsequently brought into engagement with the respective the side recesses. In this instance, the distal end of the guide projection is fitted into the guide recess formed in the wall before the side claws are fitted into the respective side recesses. Thus, the guide projection guides subsequent engagement of the side claws with the respective side recesses with high reliability, so that the erroneous operation preventer can be attached in an accurate posture.

An erroneous operation preventer used for a switch device (20) and formed in a frame shape so as to be disposed around a periphery of a switch member (22) of the switch device, wherein the switch member is pivotally supported by a shaft (24) parallel to a wall (10) with respect to a casing (21) fixed to an opening portion (11) of the wall, the switch device being configured such that pushing a first end portion (25) of the switch member causes a second end portion (26) thereof to protrude from the wall and such that an on state and an off state of the switch device are changed by pushing one of the first end portion and the second end portion of the switch member, wherein the erroneous operation preventer has a pair of side protective walls (31) configured to extend on both sides of the first end portion of the switch member when the erroneous operation preventer is disposed around the periphery of the switch member, the first end portion taking a protruding posture in which the first end portion protrudes from the wall when the switch device is in one of the on state and the off state, and wherein the side protective walls are disposed so as to cover a surface of a flange portion (21*a*) of the casing, the flange portion being disposed around the periphery of the switch member and contacting the wall.

In the erroneous operation preventer constructed as described above, an operation surface (22*a*) of the switch member may be a concave surface that connects the first end portion and the second end portion of the switch member in a longitudinal direction of the switch member, and wherein a surface (31*a*) of each of the side protective walls may be a concave surface along the operation surface of the first end portion when the first end portion is taking the protruding posture.

The erroneous operation preventer constructed as described above may further comprise a pair of side frame portions (32) that extend in the longitudinal direction on both sides of the second end portion (26) of the switch member so as to be located outwardly of the flange portion, the second end portion being opposite to the first end portion in the longitudinal direction, wherein a surface (32*a*) of each of the side frame portions may be formed along the operation surface of the second end portion when the first end portion is taking the protruding posture.

In the erroneous operation preventer constructed as described above, a distance between the side protective walls in a direction perpendicular to the longitudinal direction may be smaller than a distance between the side frame portions in the direction perpendicular to the longitudinal direction.

The erroneous operation preventer constructed as described above may further comprise an end protective wall (33) disposed between the side protective walls so as to face a distal end face (22*b*) of the first end portion, wherein the end protective wall may extend so as to be inclined such that an end portion of the end protective wall is positioned close to an apex portion (22*c*) between the distal end face and the operation surface.

The erroneous operation preventer constructed as described above may further comprise a distal frame portion (34) that connects the side frame portions on a more distal side of the second end portion of the switch member, wherein the distal frame portion may have a distal claw (35) configured to engage with a distal recess (15) formed in the wall, wherein each of the side protective walls may have a side claw (36) configured to engage with a corresponding one of side recesses (16) formed in the wall, and wherein an end face of each of the side claws may be formed so as to be inclined with respect to a longitudinal direction of the side frame portions, such that the end face is parallel to the wall when the distal claw engages with the distal recess and the side claws are positioned close to the respective side recesses.

The erroneous operation preventer constructed as described above may further comprise at least one guide projection (37) configured to be insertable into at least one guide recess (17) formed in the wall, the at least one guide projection protruding by a larger amount than the side claws.

An erroneous operation preventer used for a switch device (20) and formed in a frame shape so as to be disposed around a periphery of a switch member (22) of the switch device, wherein the switch member is pivotally supported by a shaft (24) parallel to a wall (10) in a casing (21) fixed to an opening portion (11) of the wall, the switch device being configured such that pushing a first end portion (25) of the switch member causes a second end portion (26) thereof to protrude from the wall and such that an on state and an off state of the switch device are changed by pushing one of the first end portion and the second end portion of the switch member, wherein the erroneous operation preventer has: a pair of side protective walls (31) that extend in a longitudinal direction of the switch member on both sides of the first end portion of the switch member, the first end portion taking a protruding posture in which the first end portion protrudes from the wall when the switch device is in one of the on state and the off state; and a pair of side frame portions (34) that extend in the longitudinal direction on both sides of the second end portion of the switch member, the second end portion being opposite to the first end portion in the longitudinal direction, and wherein a distance between the side protective walls in a direction perpendicular to the longitudinal direction is smaller than a distance between the side frame portions in the direction perpendicular to the longitudinal direction.

The reference numerals in the brackets attached to respective constituent elements in the above description correspond to reference numerals used in the following embodiment to identify the respective constituent elements. The reference numerals attached to each constituent element indicates a correspondence between each element and its one example, and each element is not limited to the one example.

BRIEF DESCRIPTION OF DRAWINGS

The above and other objects, features, advantages and technical and industrial significance of the present invention will be better understood by reading the following detailed description of an embodiment of the invention, when considered in connection with the accompanying drawings, in which.

DETAILED DESCRIPTION OF THE EMBODIMENT

Figure 1:
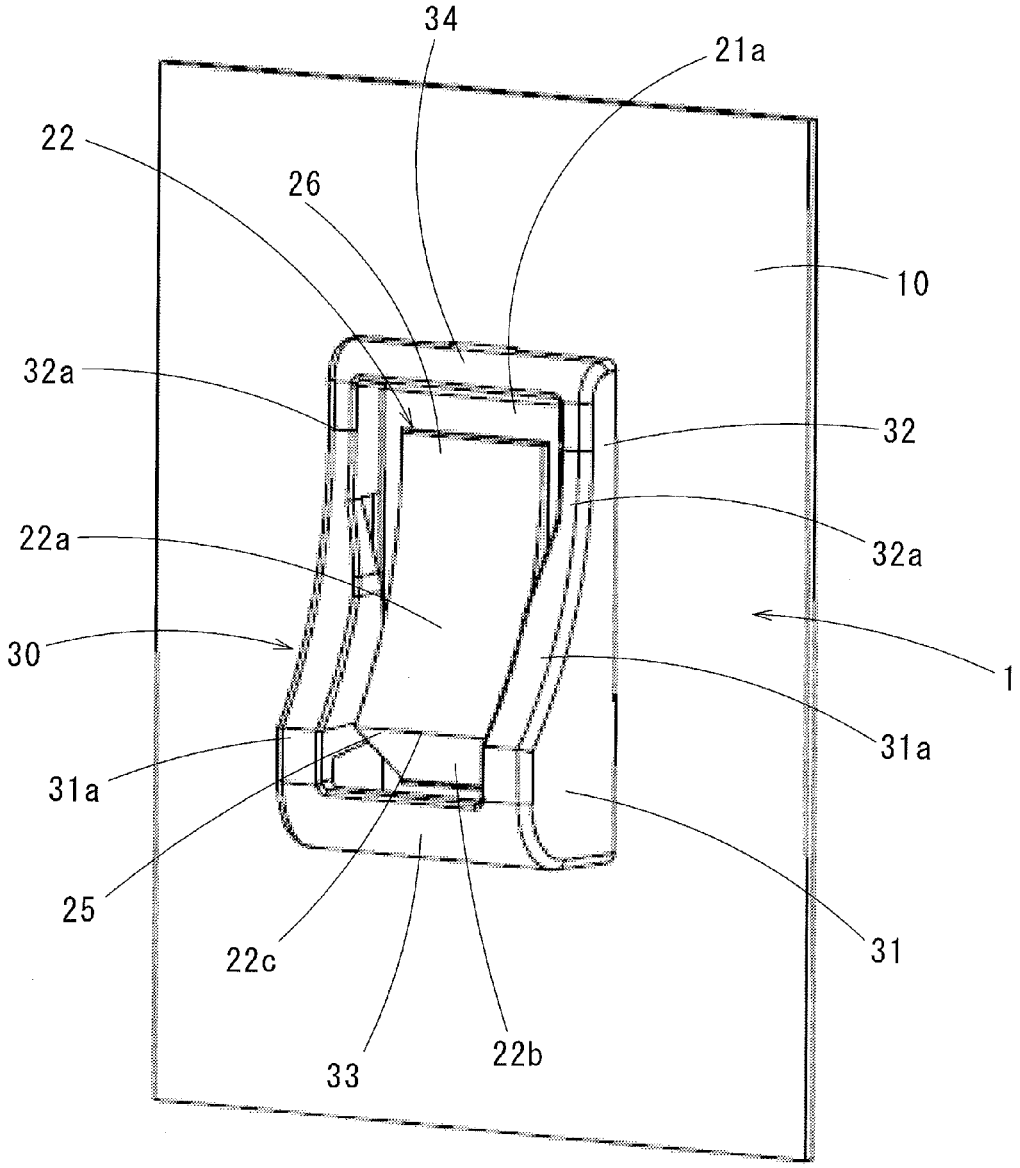
FIG. 1 is a perspective view showing a switch device with an erroneous operation preventer according to one embodiment of the invention.
Figure 2:
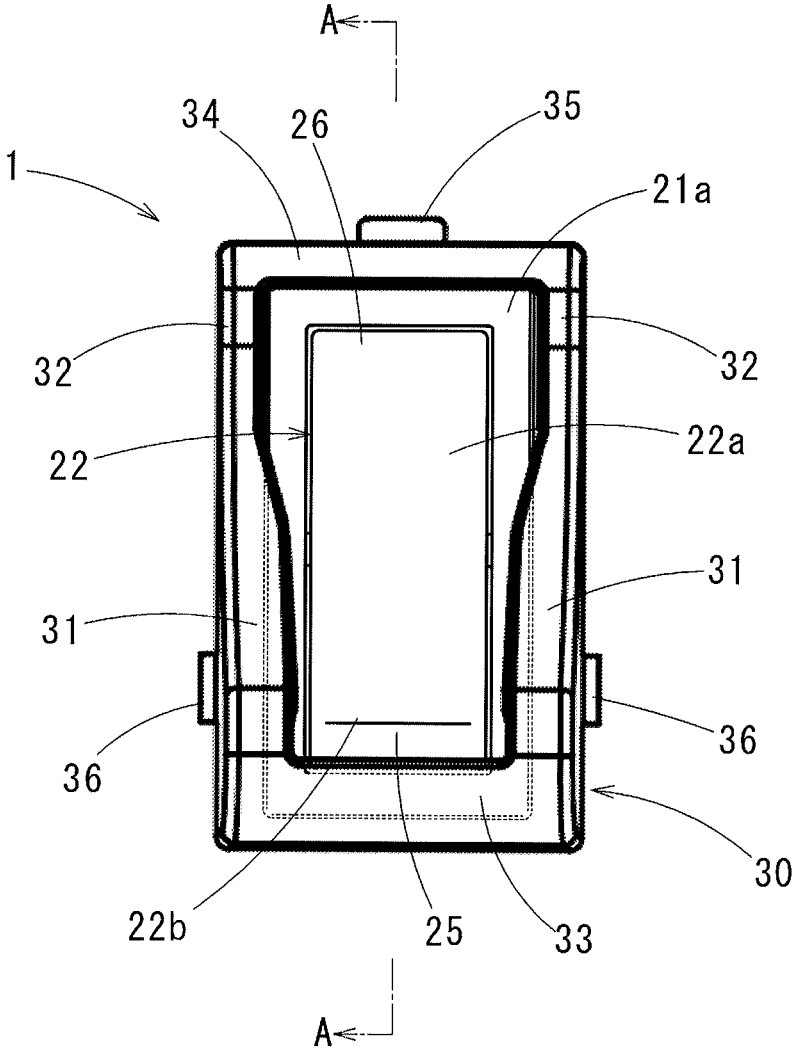
FIG. 2 is a plan view of the switch device of FIG. 1.

There will be explained a switch device with an erroneous operation preventer according to one embodiment of the invention with reference to the drawings.

A switch device 1 according to one embodiment of the present invention is disposed on a wall 10 of a housing of electric acoustic equipment. The switch device 1 has a switch main body 20 attached to an opening portion 11 of the wall 10 and an erroneous operation preventer 30 for preventing an erroneous operation on the switch main body 20.

Figure 4:
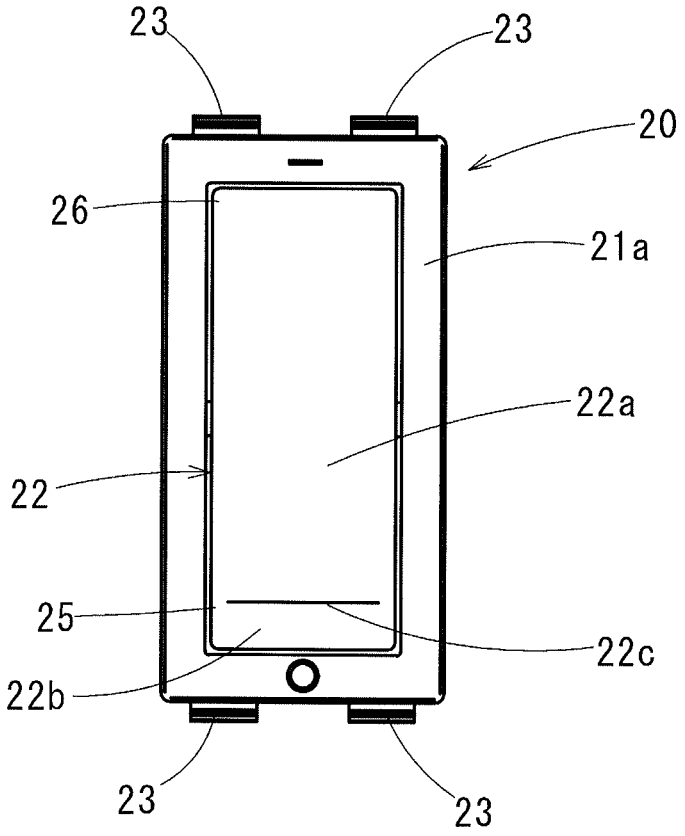
FIG. 4 is a plan view showing a switch main body according to one embodiment of the invention.
Figure 5:
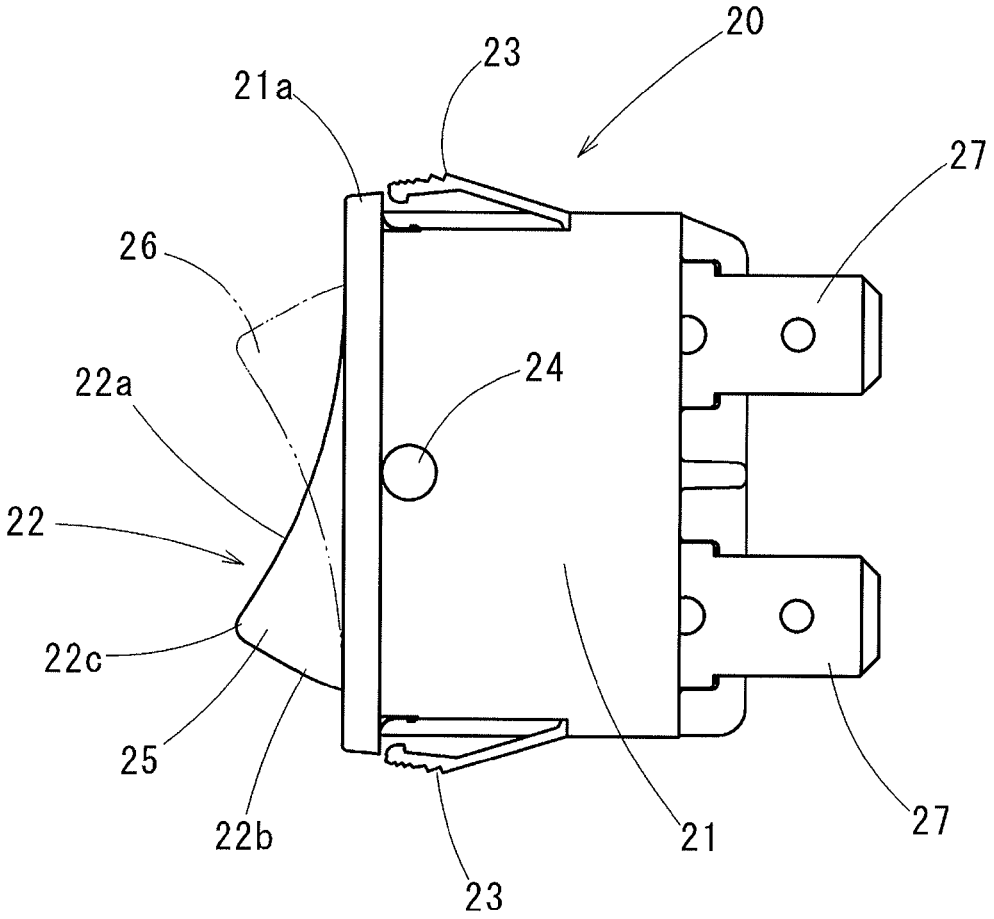
FIG. 5 is a side view showing the switch main body of FIG. 4.
Figure 6:
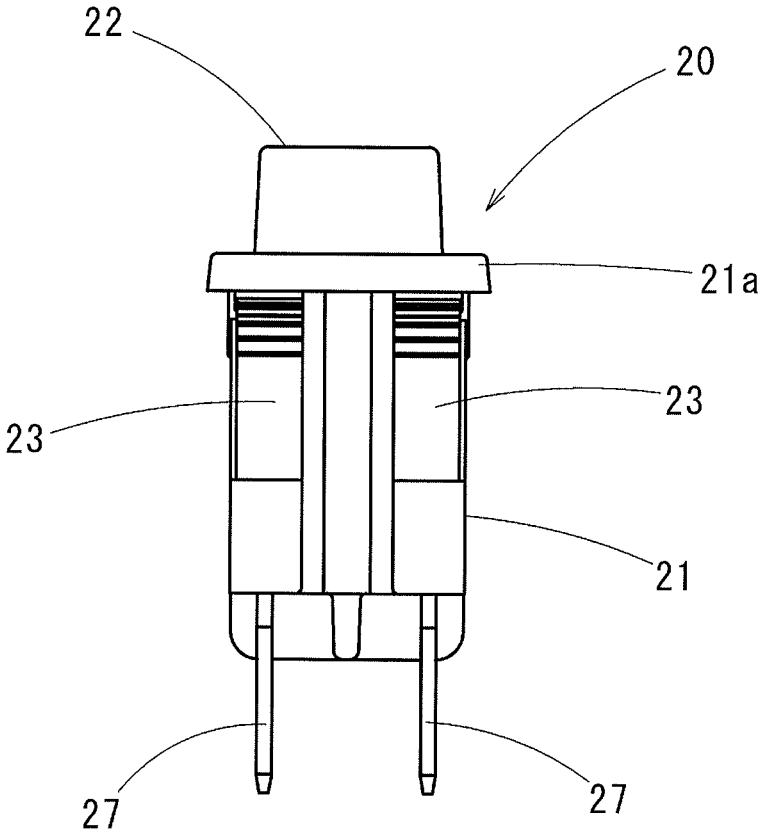
FIG. 6 is a front view showing the switch main body of FIG. 4.
Figure 7:
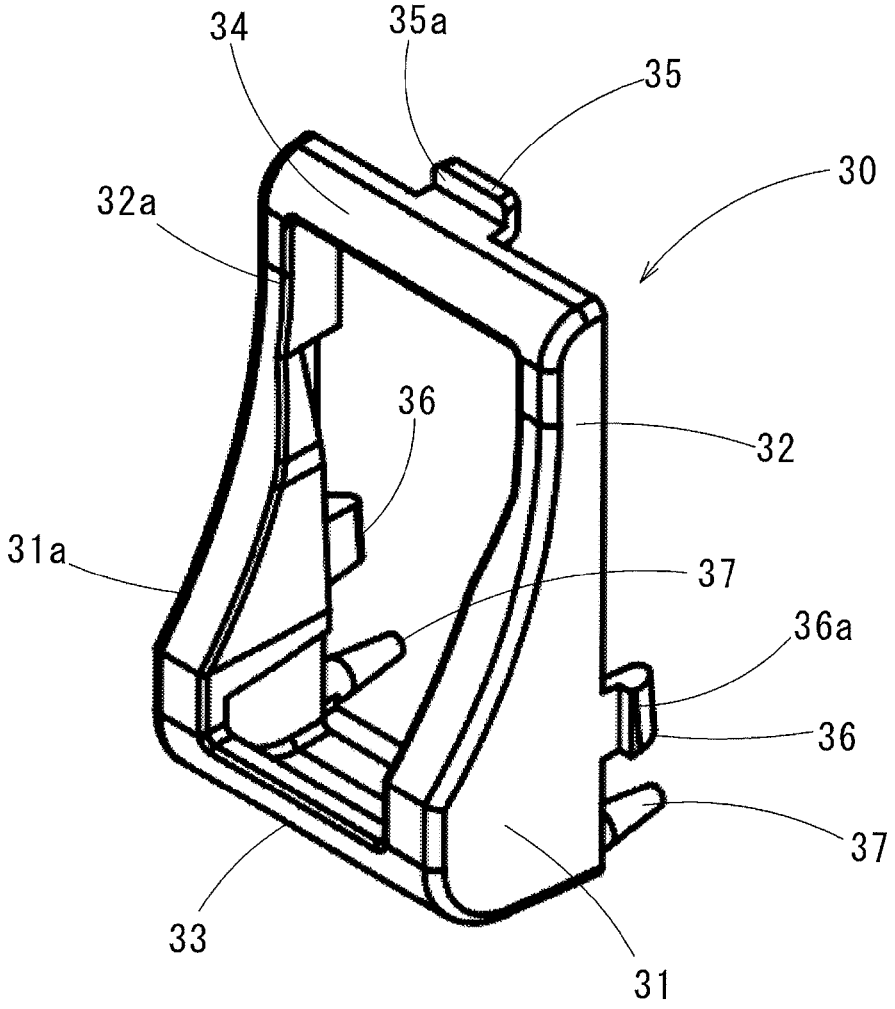
FIG. 7 is a perspective view showing an erroneous operation preventer according to one embodiment of the invention.
Figure 8:
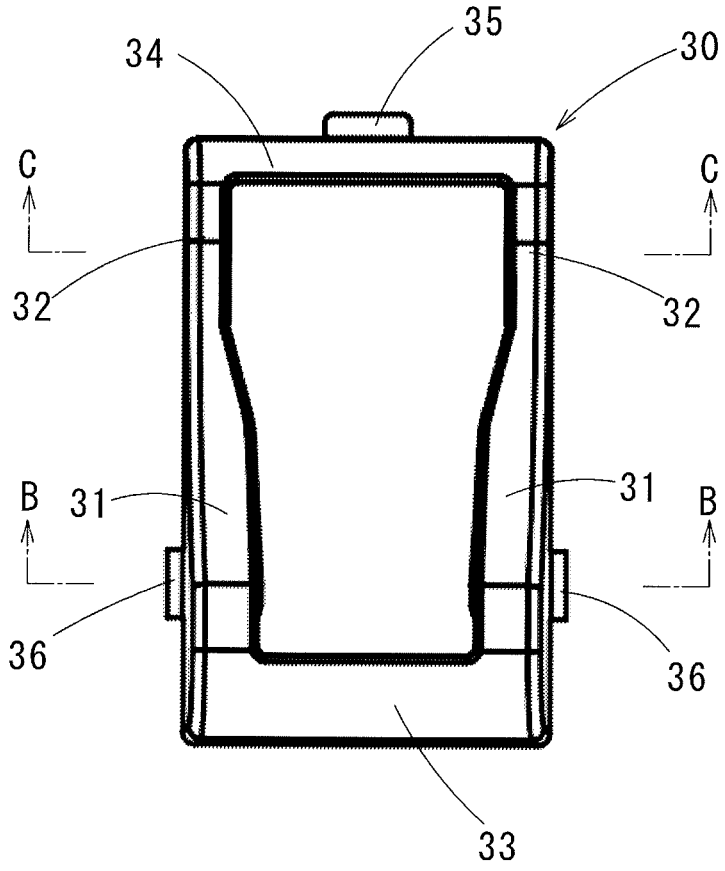
FIG. 8 is a plan view showing the erroneous operation preventer of FIG. 7.

As shown in FIGS. 4-6, the switch main body 20 has a switch mechanism portion (not shown) housed in a casing 21 and a switch member 22 a part of which is exposed to an exterior from the casing 21.

Figure 3:
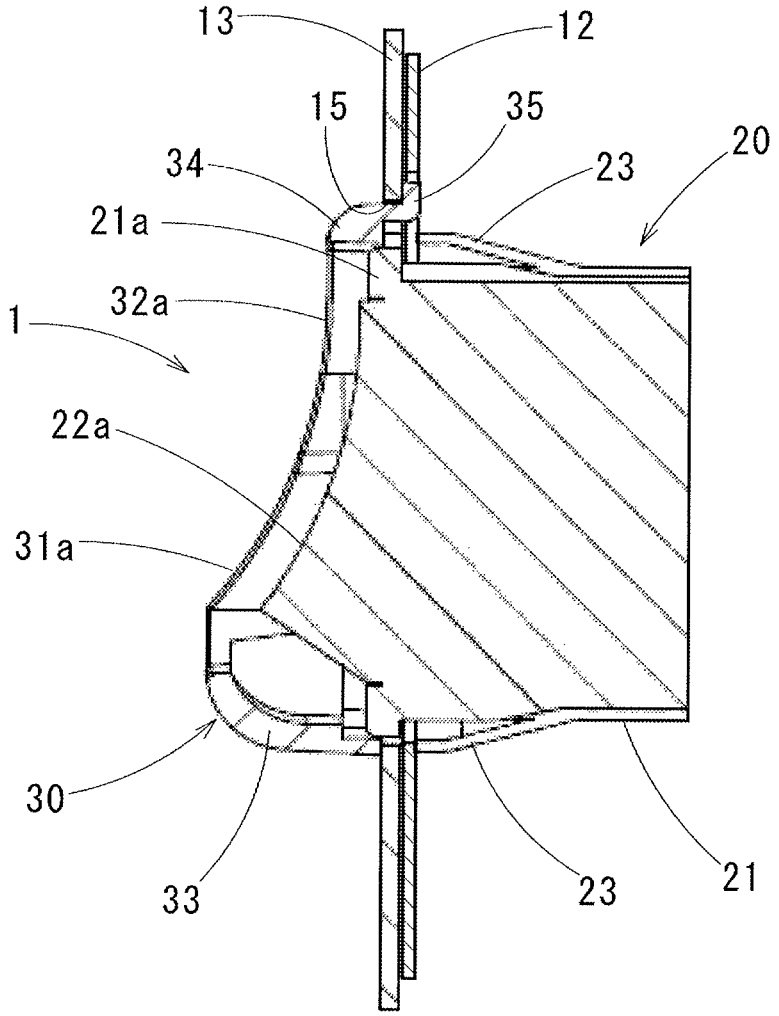
FIG. 3 is a cross-sectional view along arrows A-A in FIG. 2.
Figure 13:
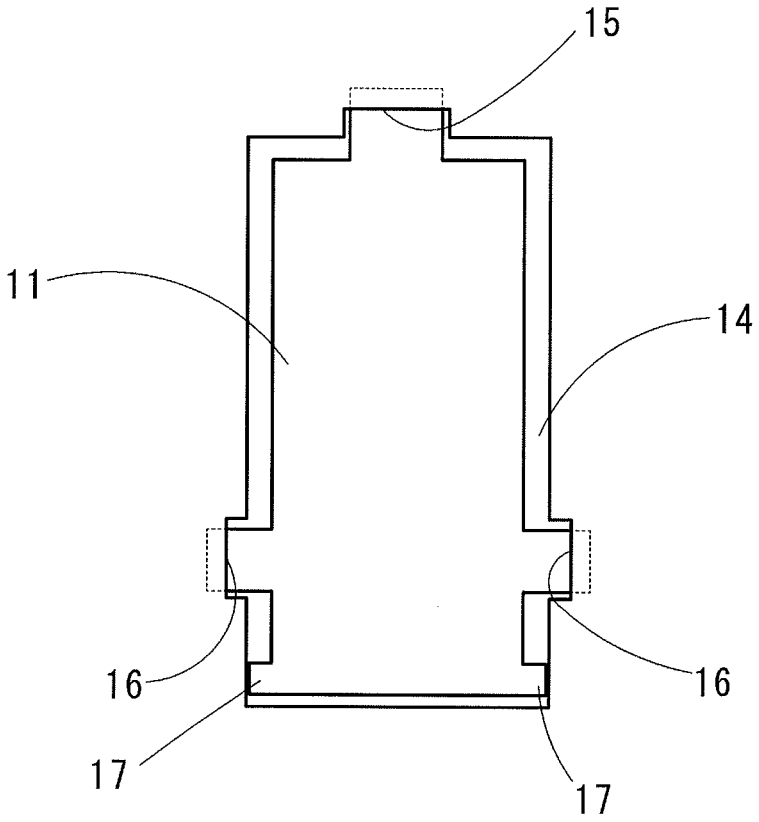
FIG. 13 is a plan view showing an opening portion and a window of a wall.

The casing 21 has a rectangular parallelepiped shape, and a substantial part of the casing 21 is housed in the opening portion 11 having a rectangular shape, as shown in FIG. 13. The casing 21 has a flange portion 21*a* integrally formed around an open end of the casing 21 from which the switch member 22 is exposed, such that the flange portion 21*a* extends outward by a certain dimension. The flange portion 21*a* is fixed with respect to the wall 10, as shown in FIGS. 1 and 3. In the present embodiment, the wall 10 is constituted by a framework wall 12 and an external panel 13 provided thereon. The opening portion 11 into which the casing 21 of the switch main body 20 is fitted is formed in the framework wall 12, and a window 14 (FIG. 13) is formed in the external panel 13. The window 14 has a size larger than that of the flange portion 21*a* of the casing 21 housed in the opening portion 11. There are provided, on front and rear surfaces of the casing 2, elastic members 23 each configured to be deformable in a front-rear direction. After the casing 21 is fitted in the opening portion 11 while the elastic members 23 are elastically deformed, the casing 21 is fixed in a state in which the framework wall 12 is sandwiched by and between the flange portion 21*a* and distal end portions of the respective elastic members 23, as shown in FIG. 3.

Like the open end of the casing 21, the switch member 22 has a rectangular shape in plan view. The switch member 22 is pivotally supported by a shaft 24 at its longitudinally central portion with respect to the casing 21. The shaft 24 is disposed in parallel with the wall 10 when the switch main body 20 is fixed to the opening portion 11 of the wall 10. A part of the switch member 22 is exposed from the casing 21, and an operation surface 22*a* is provided on the exposed surface.

The operation surface 22*a* is a concave surface that connects a first end portion 25 and a second end portion 26 of the switch member 22 in the longitudinal direction and is formed such that both end portions 25, 26 have a height larger than that of the longitudinally central portion of the switch member 22 at which the switch member 22 is supported by the shaft 24. As indicated by the solid line and the long dashed double-short dashed line in FIG. 5, the switch member 22 is a seesaw-shaped switch (which may be also referred to as "rocker switch" or "waved-shaped switch") configured such that pushing one end portion of the operation surface 22*a* causes another end portion thereof to protrude. An on state and an off state of the switch device 1 are changed by pushing one of the first end portion 25 and the second end portion 26. The concave surface (the operation surface) 22*a* is continuous at both ends thereof to respective end faces 22*b* of the switch member 22. Each of the end faces 22*b* (as one example of a distal end face) has a convex arcuate shape whose center coincides with the shaft 24.

Each reference numeral 27 denotes a terminal by which the switch main body 20 is electrically connected to an exterior.

The erroneous operation preventer 30 is formed, as a whole, in a rectangular frame shape in plan view surrounding a periphery of the switch member 22. The erroneous operation preventer 30 has: a pair of side protective walls 31 to be disposed on both sides of the first end portion 25 of the switch member 22; a pair of side frame portions 32 to be disposed on both sides of the second end portion 26 so as to be continuous to the respective side protective walls 31; an end protective wall 33 that connects end portions of the respective side protective walls 31; and an end frame portion 34 (as one example of a distal frame portion) that connects end portions of the respective side frame portions 32.

As shown in FIGS. 1, 2, 11, and 12, the side frame portions 32 and the end frame portion 34 are disposed outwardly of the flange portion 21*a* of the casing 21 of the switch main body 20 while the side protective walls 31 and the end protective wall 33 are disposed so as to cover a surface of the flange portion 21*a* of the casing 21. In this structure, a distance between inner surfaces of the respective side protective walls 31 is smaller than a distance between inner surfaces of the respective side frame portions 32, and the inner surfaces of the respective side protective walls 31 are disposed close to respective side surfaces of the switch member 22.

An upper end face 31*a* of each side protective wall 31 and an upper end face 32*a* of each side frame portion 32 are concave surfaces along the operation surface 22*a* of the switch member 22. The erroneous operation preventer 30 according to the present embodiment is configured to prevent the first end portion 25 from being erroneously pushed, the first end portion 25 taking a protruding posture in which the first end portion 25 protrudes from the wall 10 when the switch member 22 (the switch device 1) is in the on state. As shown in FIG. 3, the upper end faces 31*a* of the respective side protective walls 31 and the upper end faces 32*a* of the respective side frame portions 32 are concave surfaces along the operation surface 22*a* that are located above, by a slight amount, the operation surface 22*a* in a state in which the first end portion 25 of the switch member 22 takes the protruding posture. The slight amount corresponds to the thickness of a connecting portion of each side protective wall 31 (that will be later described).

The end protective wall 33 has a height equal to a height of the uppermost end of each side protective wall 31. The end protective wall 33 is inclined as a whole such that its upper end portion is curved so as to be disposed over the flange portion 21*a* of the casing 21 for covering the flange portion 21*a*, and an upper end of the end protective wall 33 is located close to an apex portion 22*c* between the end face 22*b* of the first end portion 25 of the switch member 22 and the operation surface 22*a*.

A claw 35 is formed integrally with a lower surface of the end frame portion 34 of the erroneous operation preventer 30 while claws 36 are formed integrally with lower surfaces of the respective side protective walls 31. The claw 35 is configured to engage with a recess 15 formed in the wall 10 while the claws 36 are configured to engage with respective recesses 16 formed in the wall 10. The erroneous operation preventer 30 is fixed to the wall 10 by engagement of the claw 35 with the recess 15 and engagement of the claws 36 with the respective recesses 16, as shown in FIGS. 11-15.

The claw 35 functions as a distal claw provided on the end frame portion 34, and the claws 36 function as side claws provided on the respective side protective walls 31. The claw 35 has a hook portion 35*a* that is curved outward while each claw 36 has a hook portion 36*a* that is curved outward. The recess 15 functions as a distal recess 16 into which the claw 35 is to be fitted while each recess 16 functions as a side recess 16 into which a corresponding one of the claws 36 is to be fitted. The distal recess 15 and the side recesses 16 are formed by partially cutting the framework wall 12 and the external panel 13, so as to partly enlarge the opening portion 11 of the wall 10 at respective locations at which the distal recess 15 and the side recesses 16 are formed.

As described above, the wall 10 is constituted by the framework wall 12 and the external panel 13. The opening portion 11 is formed in the framework wall 12 while the recesses 15, 16 are formed in the external panel 13. The framework wall 12 is partially cut at the respective locations at which the recesses 15, 16 are formed to avoid interference with the claws 35, 36 that are in engagement with the corresponding recesses 15, 16, as shown in FIG. 13.

Figure 9:
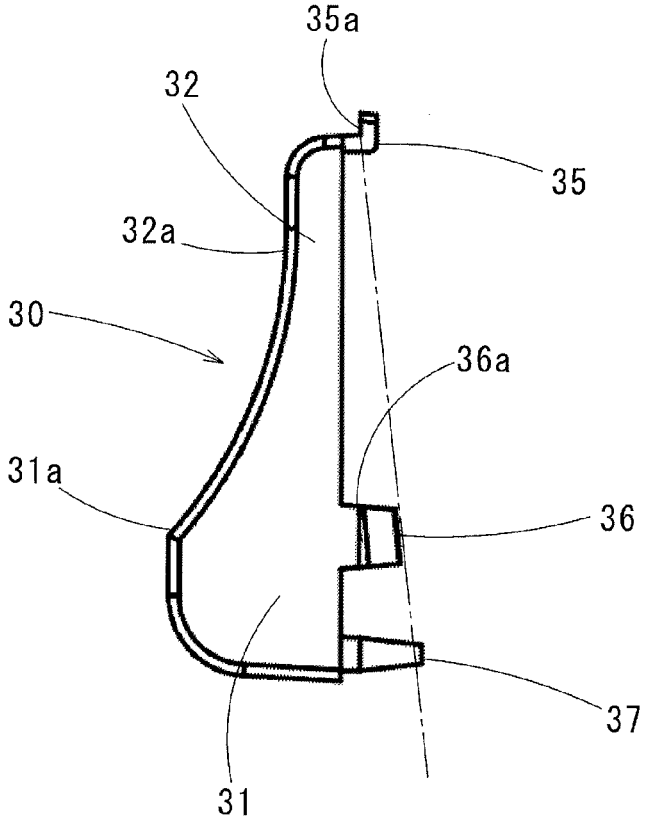
FIG. 9 is a right side view showing the erroneous operation preventer of FIG. 7.
Figure 10:
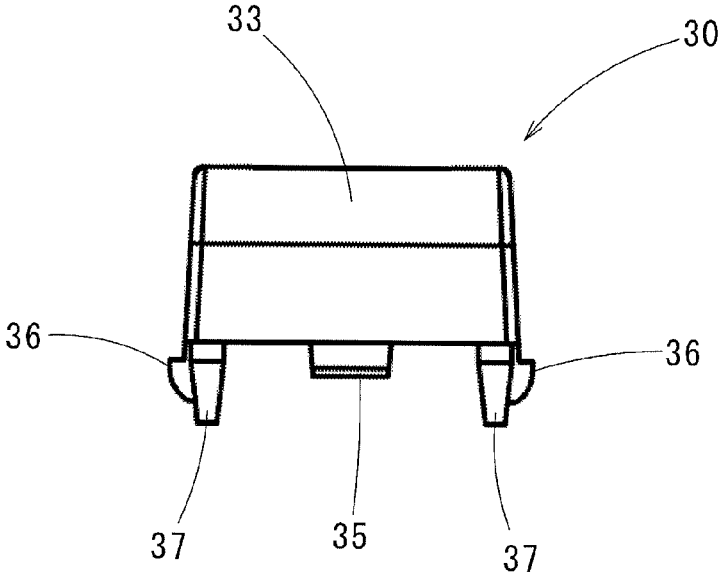
FIG. 10 is a front view showing the erroneous operation preventer of FIG. 7.

The erroneous operation preventer 30 constructed as described above is attached to the wall 10 in the following manner. Initially, the distal claw 35 is brought into engagement with the distal recess 15, and the side claws 36 are subsequently brought into engagement with the respective side recesses 16. In this respect, a lower surface of each side claw 36 is formed so as to be inclined with respect to a longitudinal direction of the corresponding side protective wall 31, such that the lower surface becomes parallel to the wall 10 when the distal claw 35 engages with the distal recess 15 and the side claws 36 are positioned close to the corresponding side recesses 16, as indicated by the long dashed short dashed line in FIG. 9.

The guide projections 37 are formed on the lower surfaces of the respective side protective walls 31, such that the guide projections 37 are nearer to the end protective wall 33 than the side claws 36 are to the end protective wall 33. The guide projections 37 protrude preferably by a larger amount than the side claws 36. Like the recesses 15, 16, the guide recesses 17 into which the guide projections 37 are respectively to be inserted are formed in the opening portion 11 of the wall 10 by partially cutting the framework wall 12 and the external panel 13, so as to partly enlarge the opening portion 11 at respective locations at which the guide recess 17 are formed. When the erroneous operation preventer 30 is attached to the wall 10, the guide projections 37 are fitted in the respective the guide recesses 17 before the side claws 36 are fitted in the respective the side recesses 16, thereby guiding engagement of the side claws 36 with the respective the side recesses 16.

Figure 11:
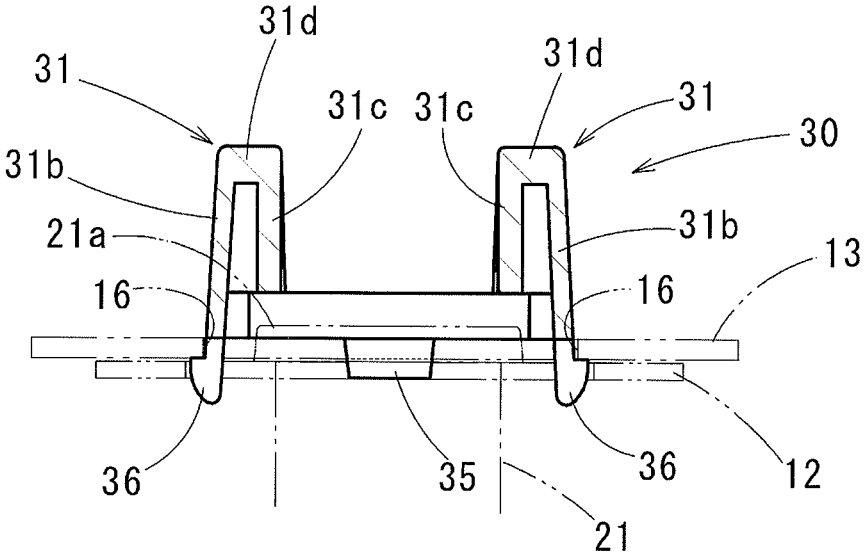
FIG. 11 is a cross-sectional view along arrows B-B in FIG. 8.
Figure 12:
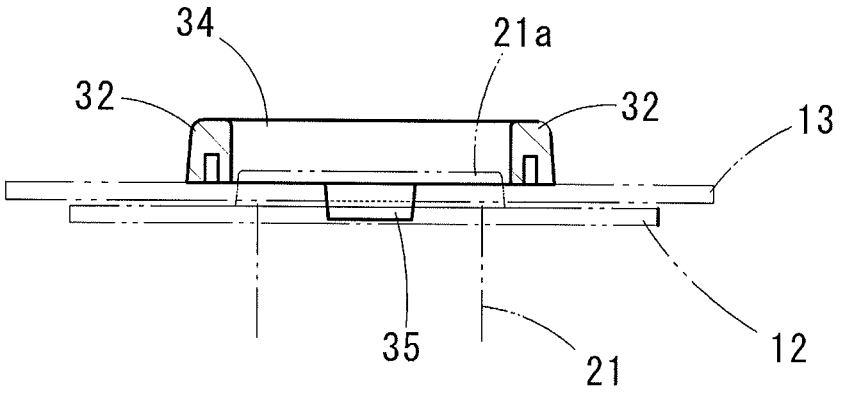
FIG. 12 is a cross-sectional view along arrows C-C in FIG. 8.

As shown in FIG. 11, each side protective wall 31 has a double wall structure constituted by an outer wall portion 31*b* and an inner wall portion 31*c*. Each side claw 36 is formed on a lower surface of the outer wall portion 31*b*. In the double wall structure, the outer wall portion 31*b* and the inner wall portion 31*c* are connected at upper ends thereof by a connecting portion 31*d*, and the lower surfaces of the respective wall portions 31*b*, 31*c* are spaced apart from each other by a predetermined distance. The outer wall portion 31*b* is inclined with respect to the inner wall portion 31*c* such that a lower end of the outer wall portion 31*b* gradually separates away from the inner wall portion 31*c*.

Figure 14:
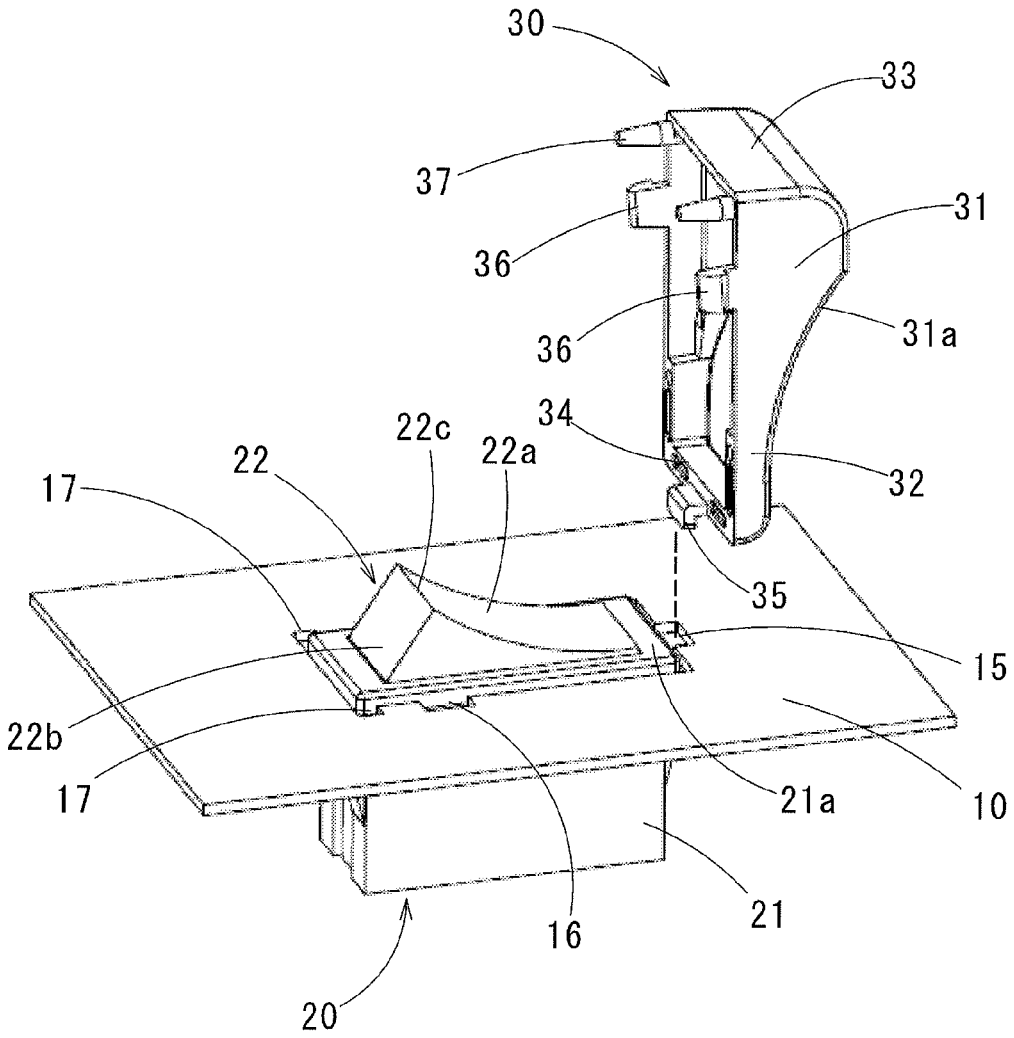
FIG. 14 is a perspective view showing a state before the erroneous operation preventer is attached to the wall.

When the switch device 1 constructed as described above is attached to the wall 10, the switch main body 20 is initially mounted onto the opening portion 11 of the wall 10, as shown in FIG. 14. The flange portion 21*a* formed on the casing 21 of the switch main body 20 engages with the periphery of the opening portion 11 and is fixed thereto from the inside of the opening portion 11 by the elastic members 23.

Figure 15:
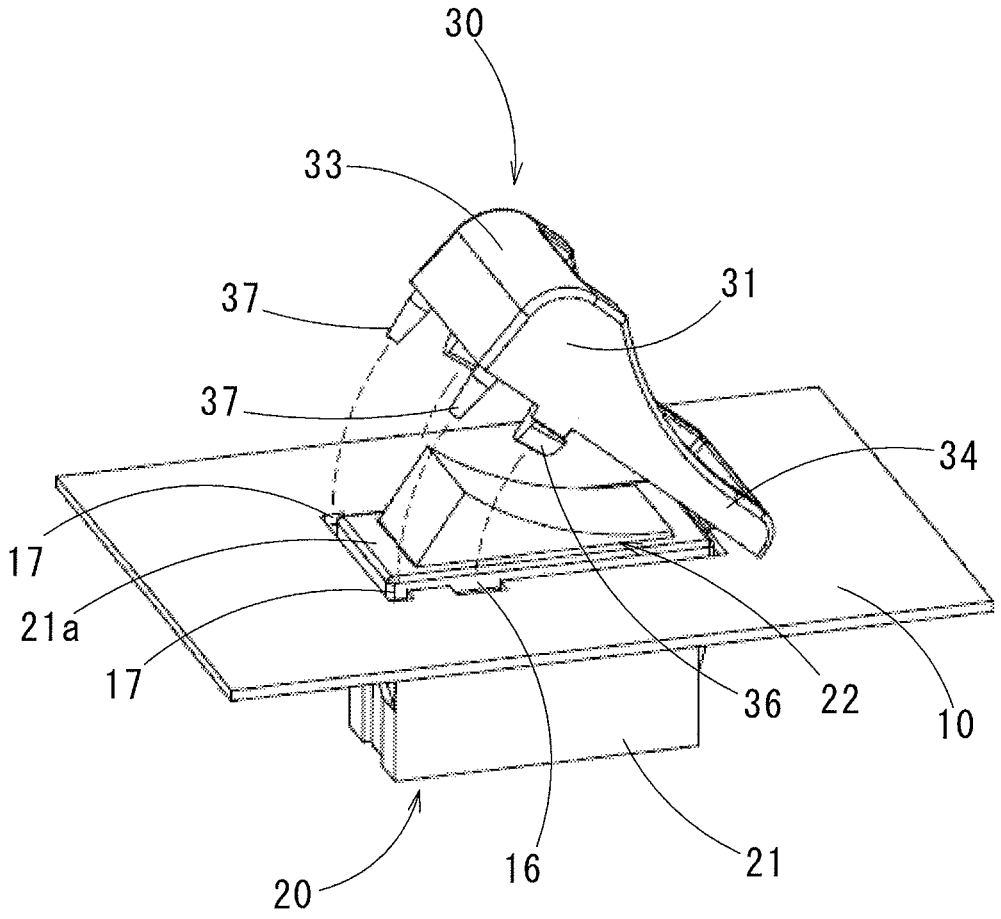
FIG. 15 is a perspective view showing a state in which the erroneous operation preventer is in the process of being attached to the wall.

When the erroneous operation preventer 30 is subsequently installed, the distal claw 35 is brought into engagement with the distal recess 15, and the side claws 36 are moved close to the wall 10 while pivoting the erroneous operation preventer 30 about the engaged portion, as shown in FIG. 15. Consequently, the guide projections 37 are inserted into the respective guide recesses 17 before the side claws 36 are fitted into the respective side recesses 16. Thereafter, the side claws 36 are brought into engagement with the side recesses 16. In this instance, the lower surface of each side claw 36 comes into contact with the wall 10 in a state in which the lower surface is in parallel with the wall 10. Subsequently, the side claws 36 are further pushed, so that the side claws 36 engage with the side recesses 16. Thus, the erroneous operation preventer 30 can be attached to the wall 10 surely and easily.

Each side claw 36 has the outwardly curved hook portion 36*a* and is provided on the outer wall portion 31*b* of the corresponding side protective wall 31. When the thus formed side claw 36 is fitted in the side recess 16, the side claw 36 is held in close engagement with the side recess 16 owing to the elasticity of the outer wall portion 31*b* of the side protective wall 31. Thus, the erroneous operation preventer 30 is fixed with high reliability.

In a state in which the erroneous operation preventer 30 is installed, the side frame portions 32 and the end frame portion 34 are disposed outwardly of the outer edge of the flange portion 21*a* of the switch main body 20 while the side protective walls 31 are disposed so as to cover the surface of the flange portion 21*a* and the inner surfaces of the inner wall portions 31*c* of the respective side protective walls 31 are disposed closer to corresponding side surfaces of the switch member 22 than the outer edge of the flange portion 21*a* is to the side surfaces of the switch member 22. Where the width of the switch member 22 is about 10 mm and the width of the flange portion 21*a* is about 15 mm, for instance, the distance between the inner surfaces of the respective side protective walls 31 is about 12 mm and the distance between the inner surfaces of the respective side frame portions 32 is about 17 mm. The upper end face 31*a* of each side protective wall 31 is a concave surface along the operation surface 22*a* of the first end portion 25 that takes the protruding posture with respect to the wall 10.

The distance between the side protective walls 31 is made small, whereby it is possible to prevent a finger from erroneously getting in between the side protective walls 31. In addition, the end protective wall 33 is provided so as to extend between the end portions of the side protective walls 31, and the upper end portion of the end protective wall 33 is positioned close to the apex portion 22*c* between the end face 22*b* of the switch member 22 and the operation surface 22*a*. Consequently, even when a finger of an operator partly gets in between the side protective walls 31 by a slight amount, the finger comes into contact with the upper end portion of the end protective wall 33 at an early stage, in other words, before the finger deeply gets in between the side protective walls 31. It is thus possible to prevent, with high reliability, the finger from further getting in between the side protective walls 31.

When the second end portion 26 that is opposite to the first end portion 25 in the longitudinal direction of the switch member 22 is in a pushed state, the second end portion 26 has a small height, as well as the side frame portions 32 disposed on both sides of the second end portion 26 and the end frame portion 34 disposed on a distal side of the second end portion 26. Because the second end portion 26 is in a pushed state (pushed posture), touching of the finger on the second end portion 26 does not cause any erroneous operation.

When the switch device 1 is in the off state in which the first end portion 25 is pushed, the second end portion 26 takes a protruding posture with respect to the wall 10, as indicated by the long dashed double-short dashed line in FIG. 5. In this instance, the height of the side frame portions 32 and the height of the end frame portion 34 are small, so that the side frame portions 32 and the end frame portion 34 do not hinder a pushing operation on the second end portion 26.

For detaching the erroneous operation preventer 30 from the wall 10, the erroneous operation preventer 30 is held such that the outer wall portions 31*b* of the respective side protective walls 31 having the double wall structure are inwardly pressed, whereby the outer wall portions 31*b* are elastically and flexibly deformed about the connecting portion 31*d*. Subsequently, by bringing the outer wall portions 31*b* close to each other, the hook portions 36*a* of the side claws 36 formed on the lower surfaces of the respective outer wall portions 31*b* can be disengaged from the corresponding side recesses 16. In this respect, because each side protective wall 31 is formed such that the upper end of the inner wall portion 31*c* and the upper end of the outer wall portion 31*b* are connected by the connecting portion 31*d*, it is difficult to elastically deform the side protective wall 31 unless the lower end portion of the outer wall portion 31*b* of the side protective wall 31 is pressed. It is thus possible to prevent the outer wall portions 31*b* from being elastically deformed inadvertently and to accordingly prevent the erroneous operation preventer 30 from dropping from the wall 10.

It is to be understood that the present invention is not limited to the details of the illustrated embodiment, but may be embodied with various other changes without departing from the spirit and scope of the invention defined in the attached claims.

While the wall 10 is constituted by the framework wall 12 and the external panel 13 in the illustrated embodiment, the wall 10 may be constituted by a single wall.

While the erroneous operation preventer 30 is constructed so as to surround the entire periphery of the switch member 22 in the illustrated embodiment, the end frame portion 34 may be omitted. In this instance, a claw corresponding to the distal claw 35 may be provided on an end portion of each side frame portion 32.

The upper end face 31*a* of each side protective wall 31 and the upper end face 32*a* of each side frame portion 32 are concave surfaces along the operation surface 22*a* of the switch member 22 in the illustrated embodiment. The upper end face 31*a* and the upper end face 32*a* may have any shape that does not impair the advantage of preventing an erroneous operation on the first end portion 25 of the switch member 22 when the first end portion 25 is taking a protruding posture with respect to the wall 10 and that does not hinder an operation on the first end portion 25 when the first end portion 25 is in a pushed state (pushed posture). For instance, the upper end face 31*a* and the upper end face 32*a* may be a flat surface or may have a step/steps, a cutout/cutouts, or the like, at a certain position/positions thereof.

The distance between the inner surfaces of the respective side protective walls 31 and the distance between the inner surfaces of the respective side frame portions 32 may be identical to each other as long as an operation on the first end portion 25 that is in a pushed state (pushed posture) is not hindered.

The concave surface that provides the operation surface 22*a* of the switch member is arcuate in the illustrated embodiment. The operation surface 22*a* may be constituted by flat surfaces that incline downward from longitudinally opposite ends of the operation surface 22*a* toward the longitudinally central portion thereof so as to have a bent shape as a whole. In this instance, the side protective walls and the side frame portions of the erroneous operation preventer may have respective shapes along the bent shape of the operation surface of the switch member.

The concave surface of the upper end face of the erroneous operation preventer need not necessarily have a shape that completely conforms to the shape of the concave surface of the switch member, but may have a shape along the shape of the concave surface of the switch member as a whole.

The guide projections 37 may be omitted. Where the guide projections 37 are omitted, the degree of ease with which the erroneous operation preventer is installed is somewhat lowered. Nevertheless, the advantage of preventing an erroneous operation on the switch member 22 to be offered after the erroneous operation preventer has been installed is ensured.

The number of guide projections 37, distal claws 35, and side claws 36 and the positions thereof are not limited to those in the illustrated embodiment. For instance, two distal claws 35 may be provided at respective two positions on the lower portion of the end frame portion 34. The two side claws 36 may be replaced with one side claw formed on the lower portion of one of the side protective walls 31.

The erroneous operation preventer may be formed of synthetic resin or metal.

The switch main body is illustrated by way of one example, and its detailed structure is not limited to that illustrated above.

What is claimed is:

1. A switch device with an erroneous operation preventer, comprising:

a switch main body attached to an opening portion of a wall and having a switch member pivotally supported by a shaft that is parallel to the wall, the switch main body being configured such that pushing a first end portion of the switch member causes a second end portion thereof to protrude from the wall and such that an on state and an off state of the switch main body are changed by pushing one of the first end portion and the second end portion of the switch member; and an erroneous operation preventer configured to prevent an erroneous operation on the first end portion of the switch member, the first end portion taking a protruding posture in which the first end portion protrudes from the wall when the switch Main body is in one of the on state and the off state, wherein the switch member is supported by the shaft in a casing fixed to the opening portion, wherein the casing has a flange portion disposed around a periphery of the switch member and engaged with a periphery of the opening portion of the wall, wherein the erroneous operation preventer is formed in a frame shape and disposed outwardly of the flange portion, and wherein the erroneous operation preventer has a pair of side protective walls that extend in a longitudinal direction of the switch member so as to cover a surface of the flange portion on both sides of the first end portion of the switch member.

2. The switch device according to claim 1, wherein an operation surface of the switch member is a concave surface that connects the first end portion and the second end portion of the switch member in the longitudinal direction, and wherein a surface of each of the side protective walls is a concave surface along the operation surface of the first end portion when the first end portion is taking the protruding posture.

3. The switch device according to claim 2, wherein the erroneous operation preventer has a pair of side frame portions that extend in the longitudinal direction on both sides of the second end portion of the switch member so as to be located outwardly of the flange portion, the second end portion being opposite to the first end portion in the longitudinal direction, and wherein a surface of each of the side frame portions is formed along the operation surface of the second end portion when the first end portion is taking the protruding posture.

4. The switch device according to claim 3, wherein a distance between the side protective walls in a direction perpendicular to the longitudinal direction is smaller than a distance between the side frame portions in the direction perpendicular to the longitudinal direction.

5. The switch device according to claim 2, wherein the erroneous operation preventer has an end protective wall disposed between the side protective walls so as to face a distal end face of the first end portion, and wherein the end protective wall extends so as to be inclined such that an end portion of the end protective wall is positioned close to an apex portion between the distal end face and the operation surface.

6. The switch device according to claim 3, wherein the erroneous operation preventer has a distal frame portion that connects the side frame portions on a more distal side than the second end portion of the switch member, wherein the distal frame portion has a distal claw configured to engage with a distal recess formed in the wall, wherein each of the side protective walls has a side claw configured to engage with a corresponding one of side recesses formed in the wall, and wherein an end face of each of the side claws is formed so as to be inclined with respect to a longitudinal direction of the side frame portions, such that the end face is parallel to the wall when the distal claw engages with the distal recess and the side claws are positioned close to the respective side recesses.

7. The switch device according to claim 6, wherein the erroneous operation preventer has at least one guide projection configured to be insertable into at least one guide recess formed in the wall, the at least one guide projection protruding by a larger amount than the side claws.

8. An erroneous operation preventer used for a switch device having a casing attached to an opening portion of a wall and formed in a frame shape so as to be disposed around a periphery of a switch member of the switch device, wherein a flange portion formed on the casing engages with a periphery of the opening portion of the wall, wherein the switch member is pivotally supported by a shaft parallel to the wall with respect to the casing, the switch device being configured such that pushing a first end portion of the switch member causes a second end portion thereof to protrude from the wall and such that an on state and an off state of the switch device are changed by pushing one of the first end portion and the second end portion of the switch member, wherein the erroneous operation preventer has a frame portion configured to be disposed outwardly of the flange portion of the casing and a pair of side protective walls configured to extend on both sides of the first end portion of the switch member when the erroneous operation preventer is disposed around the periphery of the switch member, the first end portion taking a protruding posture in which the first end portion protrudes from the wall when the switch device is in one of the on state and the off state, and wherein the side protective walls are disposed so as to cover a surface of the flange portion of the casing and inner surfaces of the side protective walls are disposed closer to corresponding side surfaces of the switch member than an outer edge of the flange portion.

9. The erroneous operation preventer according to claim 8, wherein an operation surface of the switch member is a concave surface that connects the first end portion and the second end portion of the switch member in a longitudinal direction of the switch member, and wherein a surface of each of the side protective walls is a concave surface along the operation surface of the first end portion when the first end portion is taking the protruding posture.

10. The erroneous operation preventer according to claim 9, further comprising a pair of side frame portions that extend in the longitudinal direction on both sides of the second end portion of the switch member so as to be located outwardly of the flange portion, the second end portion being opposite to the first end portion in the longitudinal direction, wherein a surface of each of the side frame portions is formed along the operation surface of the second end portion when the first end portion is taking the protruding posture.

11. The erroneous operation preventer according to claim 10, wherein a distance between the side protective walls in a direction perpendicular to the longitudinal direction is smaller than a distance between the side frame portions in the direction perpendicular to the longitudinal direction.

12. The erroneous operation preventer according to claim 9, further comprising an end protective wall disposed between the side protective walls so as to face a distal end face of the first end portion, wherein the end protective wall extends so as to be inclined such that an end portion of the end protective wall is positioned close to an apex portion between the distal end face and the operation surface.

13. The erroneous operation preventer according to claim 10, further comprising a distal frame portion that connects the side frame portions on a more distal side of the second end portion of the switch member, wherein the distal frame portion has a distal claw configured to engage with a distal recess formed in the wall, wherein each of the side protective walls has a side claw configured to engage with a corresponding one of side recesses formed in the wall, and wherein an end face of each of the side claws is formed so as to be inclined with respect to a longitudinal direction of the side frame portions, such that the end face is parallel to the wall when the distal claw engages with the distal recess and the side claws are positioned close to the respective side recesses.

14. The erroneous operation preventer according to claim 13, further comprising at least one guide projection configured to be insertable into at least one guide recess formed in the wall, the at least one guide projection protruding by a larger amount than the side claws.

* * * * *